US008726821B2

(12) United States Patent
White et al.

(10) Patent No.: US 8,726,821 B2
(45) Date of Patent: May 20, 2014

(54) HANDHELD MACHINE FOR ATTACHING HAIR WEAVE TO NATURAL HAIR

(75) Inventors: Belzoria T. White, West Palm Beach, FL (US); Pauline Ewell, Gainesville, FL (US)

(73) Assignee: Belzoria T. White, West Palm Beach, FL (US)

( * ) Notice: Subject to any disclaimer, the term of this patent is extended or adjusted under 35 U.S.C. 154(b) by 0 days.

(21) Appl. No.: 12/222,299

(22) Filed: Aug. 6, 2008

(65) Prior Publication Data

US 2009/0056733 A1 Mar. 5, 2009

Related U.S. Application Data

(60) Provisional application No. 60/935,697, filed on Aug. 27, 2007.

(51) Int. Cl.
*D05B 97/02* (2006.01)
*D05B 91/06* (2006.01)

(52) U.S. Cl.
USPC ..... 112/169; 132/273

(58) Field of Classification Search
USPC ..... 112/4, 11, 16, 52, 60, 153, 157, 451, 112/458, 169, 185, 475.03; 132/212, 223, 132/273
See application file for complete search history.

(56) References Cited

U.S. PATENT DOCUMENTS 2,604,862 A * 7/1952 Merson et al. ..... 112/169
2,639,683 A * 5/1953 Huntington ..... 112/169
2,960,946 A * 11/1960 Lutz et al. ..... 112/11
2,969,755 A * 1/1961 Reece ..... 112/112
3,034,459 A * 5/1962 Shelley ..... 112/10
3,745,950 A * 7/1973 Kato ..... 112/169
3,843,333 A * 10/1974 Seyama ..... 428/654
4,098,202 A * 7/1978 Marforio et al. ..... 112/20
4,236,467 A * 12/1980 Tanaka et al. ..... 112/444
4,284,018 A * 8/1981 Szostak ..... 112/217.4
4,307,737 A 12/1981 Shipman
4,369,690 A 1/1983 Sapkus
4,505,213 A 3/1985 Killinger (Continued)

FOREIGN PATENT DOCUMENTS

DE 37 22 108 A1 1/1989

OTHER PUBLICATIONS

Electric Hair Weaving Machine for Attaching Hair Systems, http://www.cindycut.com/weave.htm, 13 pages printed from the Internet on May 22, 2007.

(Continued)

*Primary Examiner* — Ismael Izaguirre
(74) *Attorney, Agent, or Firm* — Richard C. Litman

(57) ABSTRACT

The handheld hair weaving sewing machine has a motor driven by electric power and an on/off switch for providing electricity to the motor. A dial is provided for selecting a stitch pattern. A power switch is pressed to apply power to the motor to sew. A bobbin case containing a bobbin of thread and a bobbin thread spool for delivering thread to the needle are disposed within the machine housing. Rubber guards are provided to protect the scalp from injury. A tension dial is provided for adjusting the tension of the thread leaving the bobbin thread spool. A rotary wheel is provided for moving a needle up and down and moving the needle high enough to position the hair for properly sewing.

5 Claims, 3 Drawing Sheets

(56) References Cited

U.S. PATENT DOCUMENTS

| | | | | |
|---|---|---|---|---|
| 4,580,585 | A | 4/1986 | Sapkus | |
| 4,651,661 | A * | 3/1987 | Matsuda | 112/254 |
| D298,866 | S | 12/1988 | Reed | |
| 5,488,963 | A | 2/1996 | Fishman | |
| 5,651,322 | A * | 7/1997 | Koike | 112/169 |
| 5,669,318 | A | 9/1997 | Tsay et al. | |
| D392,293 | S | 3/1998 | Tsay et al. | |
| 5,988,181 | A | 11/1999 | Gable et al. | |
| 6,164,289 | A | 12/2000 | Ogunro et al. | |
| 6,520,187 | B1 | 2/2003 | Lee et al. | |
| 6,575,175 | B2 | 6/2003 | Kim et al. | |
| 6,662,808 | B2 | 12/2003 | Leason et al. | |
| D486,604 | S | 2/2004 | Glucksman et al. | |

OTHER PUBLICATIONS

Handy Stitch, amazon.com website: # http://www.amazon.com/AS-SEEN-TV-Handheld-Machine/dp/B000094FVG, 8 pages printed from the Internet on May 29, 2007.

* cited by examiner

HANDHELD MACHINE FOR ATTACHING HAIR WEAVE TO NATURAL HAIR

CROSS-REFERENCE TO RELATED APPLICATION

This application claims the benefit of U.S. Provisional Patent Application Ser. No. 60/935,697, filed Aug. 27, 2007.

BACKGROUND OF THE INVENTION

1. Field of the Invention

The present invention generally relates to hair styling appliances and accessories, and more particularly to a handheld machine and a method for attaching a hair weave to natural hair that stitches the hair weave to a person's natural hair.

2. Description of the Related Art

Many persons suffer from hair loss, either through natural aging or through disease. The hair loss may take the form of thinning one's natural hair, or in outright bald spots. In addition, some people may have their hair cut short, but would like to have the option of extending their hair for special occasions. Wigs or toupees offer only a partial solution, and often are so obvious that the person becomes subject to ridicule. Hair weaves offer an option that can blend in naturally with the person's remaining hair.

However, many methods of attaching hair weaves to a person's natural hair can be damaging to the hair and scalp, or difficult or inconvenient to apply. Hair weaving is being done by braiding, gluing, interlocking, hair infusion, etc. (which causes damage and tension on the hair, scalp and hair follicles, which prevents the natural hair from growing). These different methods are usually time consuming, most of the time taking many hours, and most hair weaving methods leaves some detectable lumps and bumps making the finished job look unnatural.

Thus, a handheld machine for applying a hair weave to natural hair solving the aforementioned problems is desired.

SUMMARY OF THE INVENTION

The handheld machine for attaching a hair weave to natural hair is quick, convenient, painless and applies no tension on the hair. The method or process will enhance natural hair growth while the weaved hair is sewn in. There are no lumps, no bumps, and the hair is sown in flat and undetectable even to the trained eye. The handheld hair weaving sewing machine will have multiple stitch options and tack ability, which increases hair bonding for stability and confidence.

The handheld hair sewing machine also works on all types of textures of hair, and can be taken out as quickly as it was sewn in with the safe and effective thread ripper. My vision is to have celebrities, common everyday people, cancer patients, and distressed men and women that are experiencing hair loss for whatever reason may use my alternative method of hair weaving to enhance their physical appearance. This new hair weaving process will uplift one's spirit and give them more self-confidence and joy.

The handheld hair weaving sewing machine will allow clients to change the style, color, texture, and length of their hair as frequently as they desire. The weaving machine sews in hair in the same fashion as a person would sew clothes together, flat and undetectable. The handheld apparatus can provide multiple stitch patterns and has tack ability to increase hair bonding and stability. The hair tape secures weave and natural hair in position for sewing. The thread ripper is adapted to quickly remove the hair weave safely and effectively.

The weaving machine is small and lightweight, and the size is approximately the size of a cell phone/PDA (personal digital assistant). Optionally, it can also be operated by electricity or battery. The lightweight design of the weaving machine allows for easy hand control. The process is quick, easy, and convenient for the fast pace world we live in.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
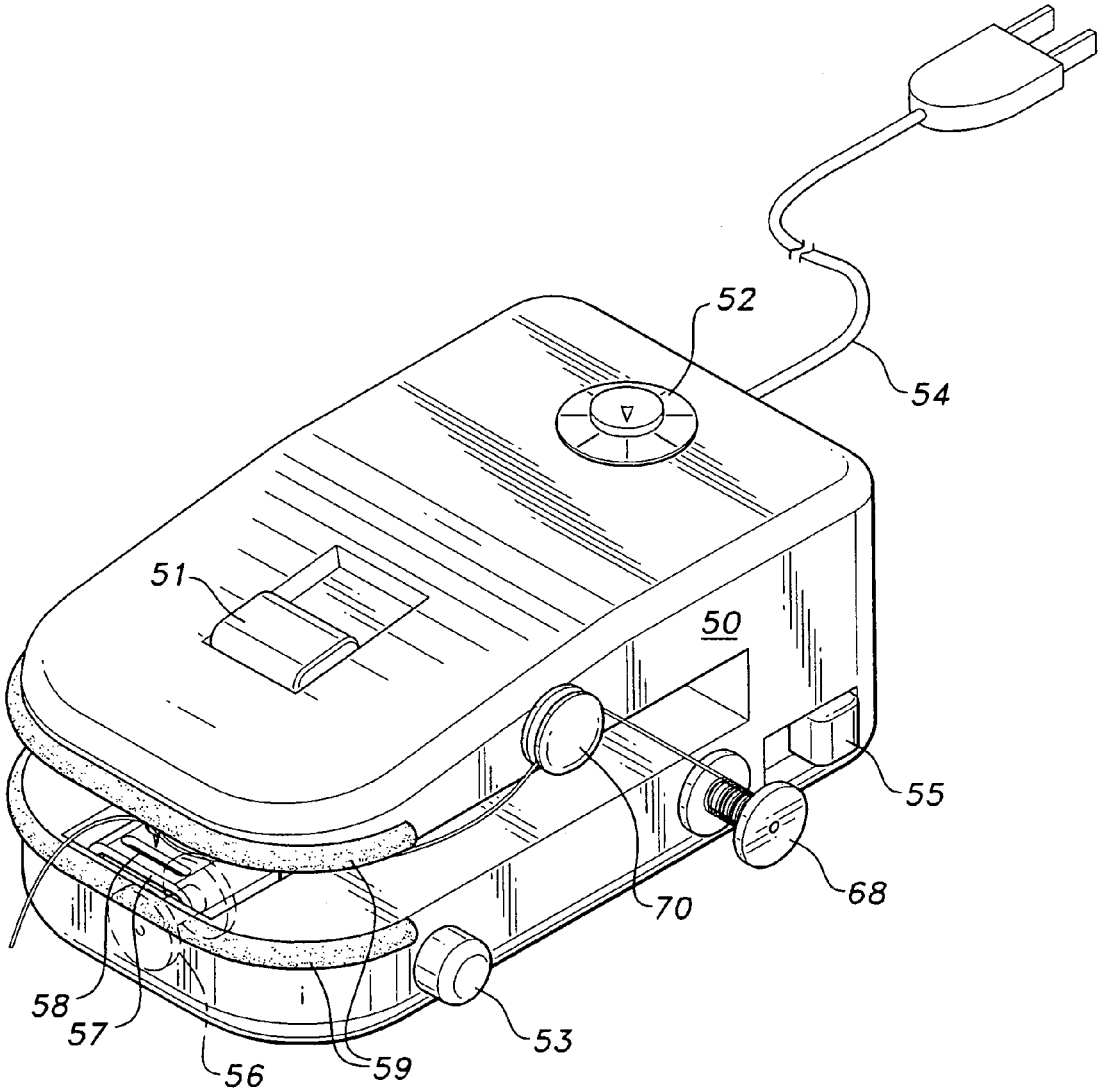
FIG. 1 is an environmental, perspective view of a handheld machine for attaching a hair weave to natural hair according to the present invention.

The present invention relates to a handheld machine 50 for attaching a hair weave to natural hair, as shown generally in FIG. 1, and to a method for attaching a hair weave to natural hair. FIG. 1 shows a power switch 51 that is pressed to sew and lock; a dial 52 for selecting multiple stitch patterns and tacking control to increase bonding security and confidence; and a rotary wheel 53 that causes the needle to move up and down and high enough so that hair can be properly positioned in place for sewing.

An on/off switch 55 is provided for actuating the machine 50 from an electrical AC outlet or, optionally, from a battery pack. The bottom portion of the machine 50 includes a bobbin and case 56; a pressure foot 57 to enable hair to be positioned for sewing; an entry point 58 for the needle; and rubber guards 59 to protect the scalp against injury when the machine 50 is placed next to the scalp during sewing.

The pressure foot 57 has a lock-in-place feature for allowing an operator to position the hair in place in the machine 50. Once the hair is positioned in the machine 50, the pressure foot 57 will be let down to hold the hair that is to be sewn in place.

The needle point of entry 58 of the machine is ⅛" or less from the head tip of the machine 50, which allows the machine 50 to sew close to the scalp and allows time for the new growth from the natural hair to come in and the weave hair not to become loose too soon. The weave hair can stay in longer before it has to be replaced or tightened.

The bobbin and case 56 in the front base of the machine 50 allows the small machine 50 to have the same stitching ability as a larger sewing machine, with a bobbin function and thread spool 68 for a secure stitch and lock pattern. The power switch 51 has a lock safety feature. Pushing the power switch 51 in an upward position allows you to begin sewing. Once sewing is stopped, pushing the power switch 51 in a downward position will lock the machine 50 and prevent needle injury. The stitch dial 52 allows the choice of different stitch patterns (single, double, zigzag, close, long or short). The operator chooses the desired stitch pattern, depending on how long they want the weaved hair to stay in.

A tension mechanism 70 will allow the machine 50 to make a smooth, secure stitch. If adjusted too loose the stitch will be too loose, and if adjusted too tight, the stitches may bunch up together. The tension mechanism 70 may be adjusted accordingly to have a good, secure stitch pattern.

A tack feature allows the machine to make 3-4 stitches in the same place at each end of the weave to allow the weave to be locked in securely. The rotary wheel 53 manually allows the needle to move up or down. The needle should go up far enough so that the hair to be sewn can be positioned in the weaving machine properly.

Figure 2:
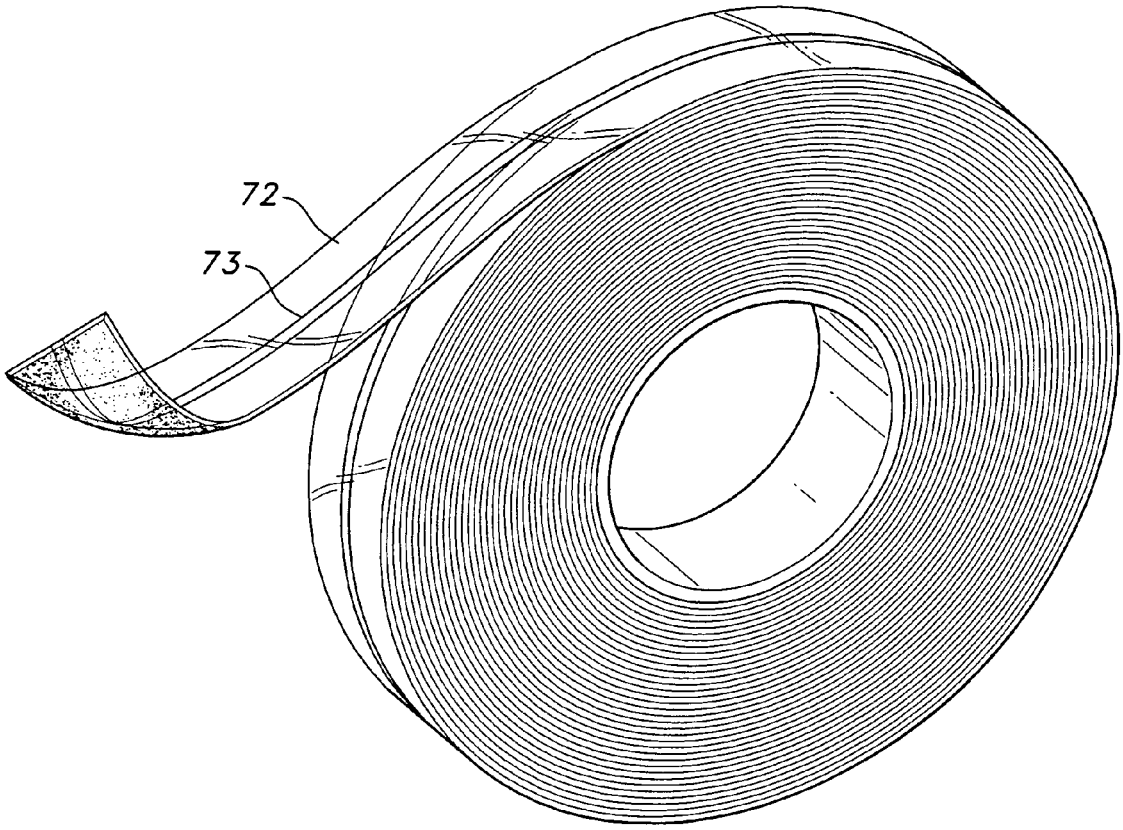
FIG. 2 is a perspective view of hair tape used with the handheld machine for attaching a hair weave to natural hair according to the present invention.

An accessory to the weaving process is hair tape 72, shown in FIG. 2. The hair tape 72 is transparent in order to enable the hair weave to be positioned close to the scalp. The hair tape 72 has a visual line 73 that will be placed on the wedge of the weave. The weave will be sewn to the natural hair on the wedge of the weave. The hair tape 72 is 1" to 1½ inches in width. The hair tape 72 has an adhesive that will hold the natural hair and the weave in position for sewing. After the hair is sewn together, the hair tape 72 will peel off easily due to the breaks in the tape created during the sewing process.

Figure 3:
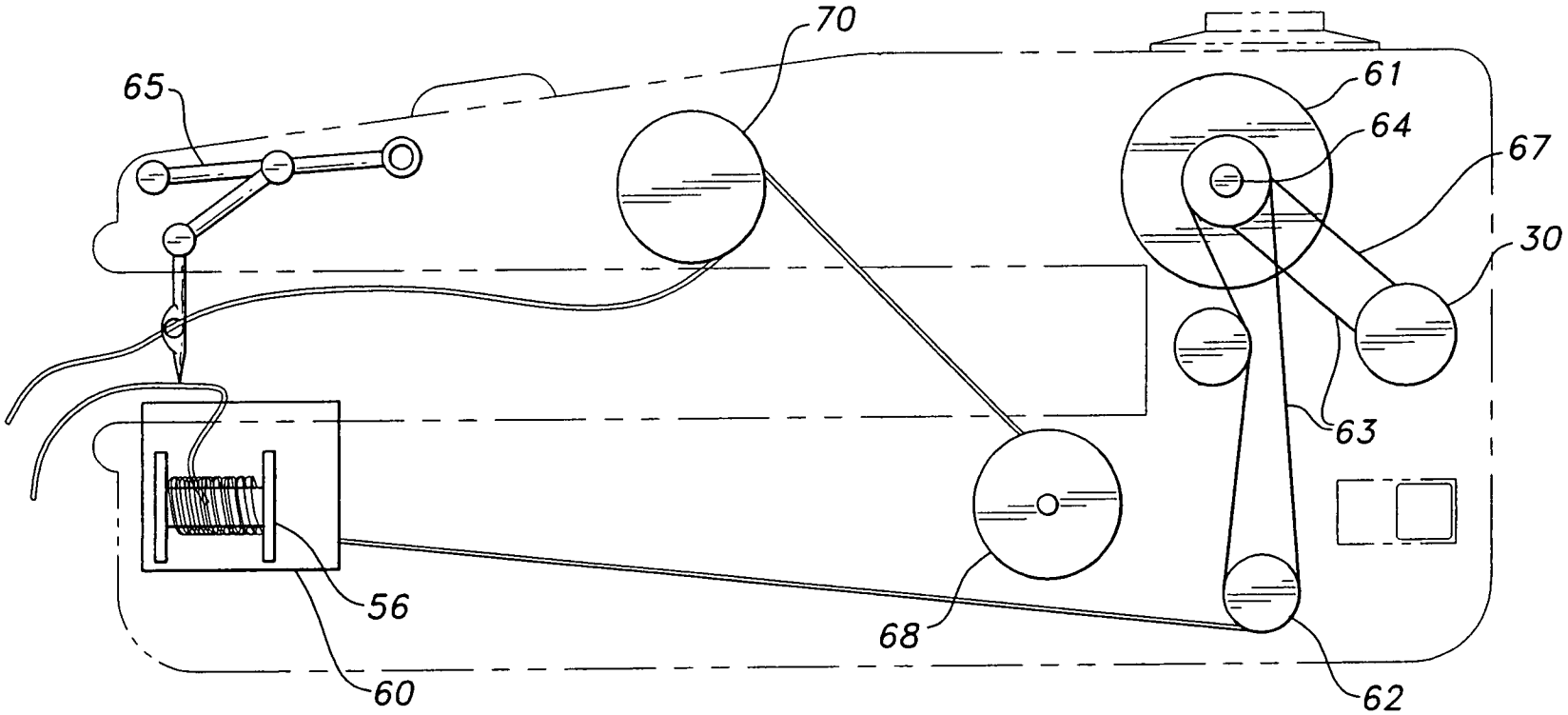
FIG. 3 is a diagrammatic side view of a handheld machine for attaching a hair weave to natural hair according to the present invention, showing selected components of the machine.

FIG. 3 shows an electric motor 30 connected to a drive wheel 61 by a drive belt 67. The drive wheel 61 rotates the long upper drive shaft 64 that is connected to several different mechanical elements. The end of the shaft 64 turns a crank, which pulls the needle bar 65 up and down. The crank also moves the thread to create enough slack for a loop to form underneath the material, and then pulls up to tighten the loop after it is released from the shuttle hook.

The thread runs from a spool 68 on a lower side of the machine, through the tightening arm and through a tension dial 70. By turning the tension dial 70, the operator can tighten the thread feeding into the needle. The tension should be tight when sewing thinner material and looser when sewing thicker material.

The machine 50 has a lock stitch mechanism. The most important element of the lock stitch mechanism is the shuttle hook and bobbin assembly. The bobbin 56 is a spool of thread positioned underneath the material and sits in the middle of a shuttle, which is rotated by the machine's motor 30 in synch with the motion of the needle. The needle pulls a loop of thread through the material, rises again as the feed dogs move the material along, and then pushes another loop in. But instead of joining the different loops together, the stitching mechanism joins them to another length of thread that comes from the bobbin 56. When the needle pushes a loop through the material, the rotary shuttle grips the loop with a hook. As the shuttle rotates it pulls the loop around the thread coming from the bobbin 56. This makes for a sturdy stitch.

The first element along the upper drive shaft 64 is a simple belt 63 that turns a lower drive shaft 62. The end of the lower drive shaft 62 is connected to a set of bevel gears that rotates the shuttle assembly. Since both are connected to the same drive shaft, the shuttle assembly and the needle assembly always move in unison. The lower drive shaft 62 also moves linkages that operate the feed dog mechanism 60. One linkage slides the feed dog 60 forward and backward with each cycle. At the same time, another linkage moves the feed dog 60 up and down. The two linkages are synchronized so that the feed dog 60 presses up against the material, shifts it forward, and then moves down to release the material. The feed dog 60 then shifts backward before pressing up against the material.

When it is desired to remove the weave, a thread ripper is used to rip the threads for fast and easy removal. The thread ripper is an elongated hook with a razor sharp edge for cutting through the threads.

It is to be understood that the present invention is not limited to the embodiment described above, but encompasses any and all embodiments within the scope of the following claims.

We claim:

1. A handheld machine for attaching a hair weave to natural hair, comprising:

a housing;

a motor having a shaft, the motor being disposed in the housing;

an on/off switch connected to the motor;

a dial for selecting a stitch pattern, the dial being mounted on the housing;

a power switch connected to the motor, the motor shaft rotating when the on/off switch is in the "on" position and the power switch is pressed;

a bobbin case and a bobbin of thread disposed within the case, the bobbin case being disposed within the housing;

a needle;

a linkage connecting the needle to the motor shaft, the linkage being operable to cause the needle to reciprocate when the shaft rotates;

a primary thread spool for delivering thread to the needle when the needle reciprocates;

guard members disposed on the housing, the guard members being adapted for abutting a user's scalp during use to protect the scalp from injury;

a tension dial disposed on the housing, the tension dial adjusting the tension of the thread leaving the bobbin thread spool;

a rotary wheel disposed on the housing, the rotary wheel moving the needle up and down manually;

a plate disposed beneath the needle and above the bobbin case, the plate having a needle opening defined therein, the plate being adapted for supporting a portion of the hair weave and strands of the natural hair of a user's head thereon above the needle opening in order to stitch the hair weave and the natural hair together; and a needle point of entry having a distance of approximately one eighth of an inch or less from a head tip of the machine, the point of entry distance allowing the machine to sew close to the scalp.

2. The handheld machine according to claim 1, further comprising a lock safety device for locking the machine to prevent needle injury when the machine is powered off.

3. The handheld machine according to claim 1, wherein the stitch dial has single, double, zigzag, close, long and short stitch pattern selection settings.

4. The handheld machine according to claim 1, further comprising a tack mechanism for allowing the machine to make a plurality of stitches in a same place at each end of a weave, thereby allowing the weave to be locked in securely.

5. The handheld machine according to claim 1, wherein the guard members are adjacent the needle point of entry and are made from rubber.

* * * * *